US009130280B2

(12) United States Patent
Liu

(10) Patent No.: US 9,130,280 B2
(45) Date of Patent: Sep. 8, 2015

(54) PHASED-ARRAY SMART ANTENNA AND METHODS FOR OPERATING THE PHASED-ARRAY SMART ANTENNA

(71) Applicant: WISTRON CORP., New Taipei (TW)

(72) Inventor: Yen-Chih Liu, New Taipei (TW)

(73) Assignee: Wistron Corp., New Taipei (TW)

( * ) Notice: Subject to any disclaimer, the term of this patent is extended or adjusted under 35 U.S.C. 154(b) by 343 days.

(21) Appl. No.: 13/782,506

(22) Filed: Mar. 1, 2013

(65) Prior Publication Data

US 2014/0018019 A1 Jan. 16, 2014

(30) Foreign Application Priority Data

Jul. 13, 2012 (TW) ..... 101125238 A

(51) Int. Cl.
*H01Q 21/00* (2006.01)
*H01Q 21/29* (2006.01)
*H01Q 3/30* (2006.01)

(52) U.S. Cl.
CPC . *H01Q 21/29* (2013.01); *H01Q 3/30* (2013.01)

(58) Field of Classification Search
CPC ..... H01Q 21/29; H01Q 3/30
USPC ..... 343/700 MS, 853, 893; 342/374
See application file for complete search history.

(56) References Cited

U.S. PATENT DOCUMENTS

| | | | | |
|---|---|---|---|---|
| 2,412,159 | A * | 12/1946 | Leeds | 342/374 |
| 2,412,160 | A * | 12/1946 | Longfellow | 342/374 |
| 5,923,290 | A | 7/1999 | Mikami et al. | |
| 7,385,563 | B2 * | 6/2008 | Bishop | 343/844 |
| 7,394,433 | B2 * | 7/2008 | Li et al. | 343/702 |
| 7,724,718 | B2 | 5/2010 | Lee et al. | |
| 2006/0164320 | A1 * | 7/2006 | Lastinger et al. | 343/893 |
| 2007/0152893 | A1 * | 7/2007 | Chiang et al. | 343/702 |
| 2009/0237321 | A1 | 9/2009 | Lin et al. | |
| 2009/0322648 | A1 * | 12/2009 | Bishop et al. | 343/893 |

FOREIGN PATENT DOCUMENTS

CN 101047282 A 10/2007

OTHER PUBLICATIONS

China Patent Office, Office Action, Patent Application Serial No. 201210269905.X, Feb. 11, 2015, China.

* cited by examiner

*Primary Examiner* — Tho G Phan

(57) ABSTRACT

A phased-array smart antenna for transmitting an electronic wave signal having a wavelength includes a first antenna, a second antenna, and a third antenna. The first antenna, the second antenna, and the third antenna form a triangle and are respectively located at three vertices of the triangle. The first antenna, the second antenna, and the third antenna are activated at the same time for transmitting the electronic wave signal.

8 Claims, 7 Drawing Sheets

PHASED-ARRAY SMART ANTENNA AND METHODS FOR OPERATING THE PHASED-ARRAY SMART ANTENNA

CROSS REFERENCE TO RELATED APPLICATIONS

This Application claims priority of Taiwan Patent Application No. 101125238, filed on Jul. 13, 2012, the entirety of which is incorporated by reference herein.

BACKGROUND OF THE INVENTION

1. Field of the Invention

The invention relates to an antenna structure and the operations thereof, and more particularly to an antenna structure with adjustable antenna fields and the operations thereof.

2. Description of the Related Art

The antenna utilized in traditional wireless communications products is usually a single omni-directional antenna device, in order to achieve 360-degree coverage. As an example shown in FIG. 1 in U.S. Pat. No. 7,724,718, which is a diagram of a network topology utilizing an access point 50 in a space, and the access point 50 covers a 360-degree coverage range as shown by the dotted lines.

However, because the antenna gain of the omni-directional antenna device is usually small, the distance of wireless communications is therefore limited. Another common design in wireless communications products is to use several directional antennas. The direction of signal transmission can be controlled by selecting different antennas for transmission. However, since only one antenna is selected at one time, the remaining antennas are left unused and the antenna gain cannot be improved even if multiple antennas are utilized.

Therefore, a novel antenna structure and the operations thereof that can efficiently increase the antenna gain when using multiple antennas are required.

BRIEF SUMMARY OF THE INVENTION

Phased-array smart antennas and methods for operating the phased-array smart antennas are provided. An exemplary embodiment of a phased-array smart antenna for transmitting an electronic wave signal having a wavelength comprises a first antenna, a second antenna, and a third antenna. The first antenna, the second antenna, and the third antenna form a triangle and the first antenna, the second antenna, and the third antenna are respectively located at three vertices of the triangle, and the first antenna, the second antenna, and the third antenna are activated at the same time for transmitting the electronic wave signal.

An exemplary embodiment of a method for operating a phased-array smart antenna, comprising a first antenna, a second antenna, and a third antenna, for transmitting an electronic wave signal having a wavelength, comprises: respectively controlling the levels of a first voltage provided to a first node of the first antenna, a second voltage provided to a second node of the second antenna, and a third voltage provided to a third node of the third antenna, so as to adjust a first phase of the electronic wave signal at a feeding point of the first antenna, a second phase of the electronic wave signal at a feeding point of the second antenna, and a third phase of the electronic wave signal at a feeding point of the third antenna, wherein the first antenna, the second antenna, and the third antenna form a triangle and are respectively located at three vertices of the triangle; and activating the first antenna, the second antenna, and the third antenna at the same time for transmitting the electronic wave signal.

A detailed description is given in the following embodiments with reference to the accompanying drawings.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

As discussed above, to solve the above-mentioned problems, a novel antenna structure and the operations thereof that can efficiently increase the antenna gain when using multiple antennas are proposed. In addition, in the proposed antenna structure and the operations thereof, antenna fields are adjustable by controlling phases of signals at the antenna's feeding points, such that the transmitted signals can have directionality to further improve the antenna gain and increase the signal-to-noise ratio. These are very helpful against the multipath fading effect in the wireless communications system and further stabilizing the signal quality.

Figure 1:
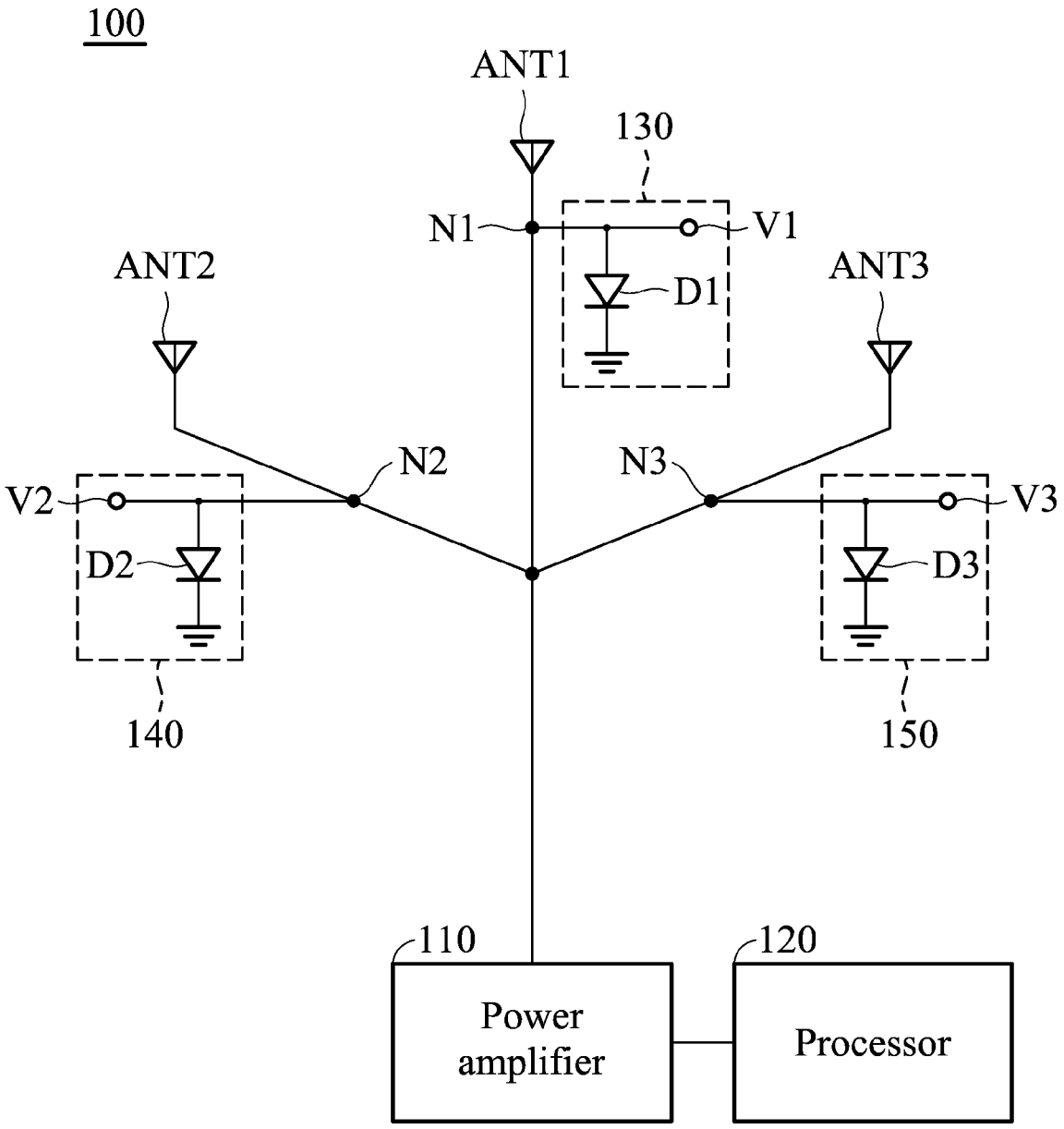
FIG. 1 shows a schematic diagram of a phased-array smart antenna according to an embodiment of the invention.

FIG. 1 shows a schematic diagram of a phased-array smart antenna according to an embodiment of the invention. The phased-array smart antenna 100 may comprise three antennas ANT1, ANT2, and ANT3. The antennas ANT1, ANT2, and ANT3 may be omni-directional antennas. According to an embodiment of the invention, the antennas ANT1, ANT2, and ANT3 may form a triangle, and the antennas ANT1, ANT2, and ANT3 may be respectively disposed at three vertices of the triangle.

The power amplifier 110 may be coupled to the three antennas ANT1, ANT2, and ANT3 for passing the amplified electronic wave signals through transmission lines to the antennas ANT1, ANT2, and ANT3. According to an embodiment of the invention, the transmission lines disposed between the power amplifier 110 and each antenna may be designed as having equal length. That is, the distances between the power amplifier 110 and each antenna are identical. In addition, according to an embodiment of the invention, the smart antenna 100 may further comprise control circuits 130, 140, and 150. The control circuit 130 may be coupled to the antenna ANT1 at the node N1, the control circuit 140 may be coupled to the antenna ANT2 at the node N2, and the control circuit 150 may be coupled to the antenna ANT3 at the node N3.

Each of the control circuits 130, 140, and 150 may respectively comprise a P-intrinsic-N diode (PIN) diode (such as the PIN diodes D1, D2, and D3 shown in FIG. 1) coupled between the nodes N1, N2, N3 and the ground node. According to an embodiment of the invention, the phased-array smart antenna 100 may further comprise a processor 120 for controlling the level of the voltages V1, V2, and V3 respectively provided to the nodes N1, N2, and N3. In the embodiment of the invention, the processor 120 may be a central processing unit, a microprocessor, a digital-signal processor, or any other device with signal processing capability. Note that in other embodiments of the invention, the processor 120 may also be not comprised in the phased-array smart antenna 100. Therefore, the invention should not be limited to the embodiment as illustrated above.

According to an embodiment of the invention, the antennas ANT1, ANT2, and ANT3 are preferably disposed at three vertices of an equilateral triangle. The side length of the equilateral triangle may be designed as $$\frac{\sqrt{3}}{12}n\lambda,$$

where n is a positive integer and λ is the wavelength of the electronic wave signals to be transmitted. For example, suppose that the frequency f of the electronic wave signals to be transmitted is 2.4 GHz, a wavelength of the electronic wave signals to be transmitted can be derived via the equation $f\lambda=C$, where C represents the speed of light ($C=3\times10^8$). In addition, according to an embodiment of the invention, the antennas ANT1, ANT2, and ANT3 may be activated at the same time to transmit the amplified electronic wave signals, for obtaining better antenna gain.

Figure 2:
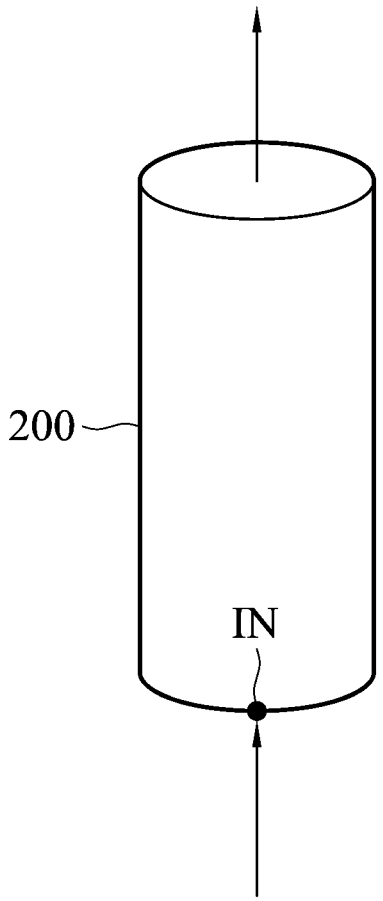
FIG. 2 shows a schematic diagram of an antenna according to an embodiment of the invention.

FIG. 2 shows a schematic diagram of an antenna according to an embodiment of the invention. The arrows in the figure indicate the signal transmitting directions, and the node IN is the feeding point at which the electronic wave signals feed in the antenna 200. According to a concept of the invention, by respectively controlling the levels of the voltages V1, V2, and V3, the phases of the amplified electronic wave signals at the corresponding feeding point of each antenna may be adjusted accordingly, such that the electronic wave signals transmitted by the three antennas can have directionality and finally the energy of the electronic wave signals transmitted by the three antennas can be accumulated and the electronic wave signals can be transmitted along the same direction. The methods for operating a phased-array smart antenna will be discussed in more detail in the following paragraphs.

Figure 3:
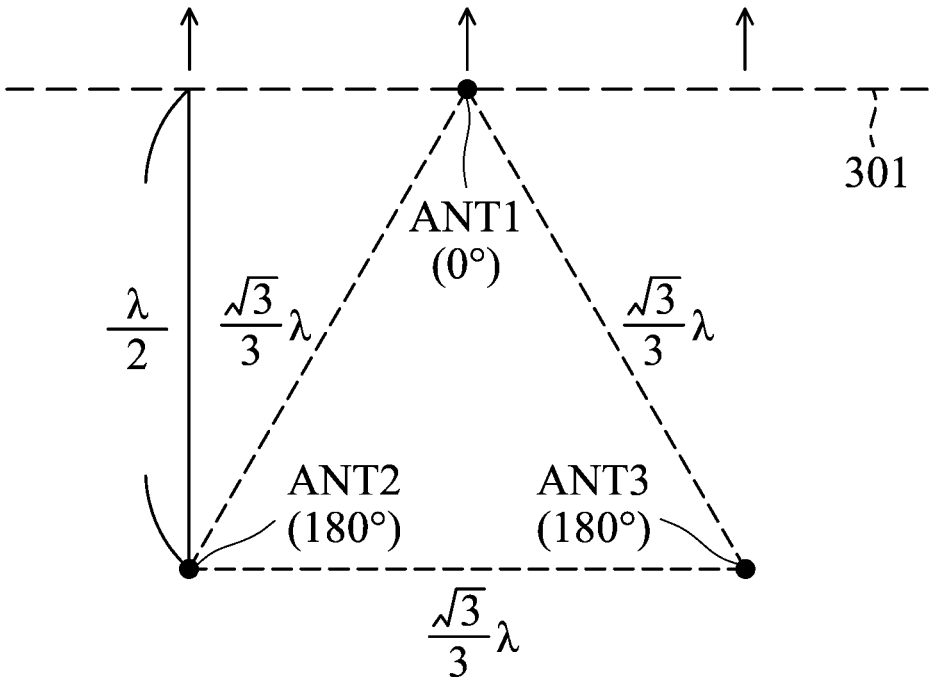
FIG. 3 shows an exemplary antenna arrangement according to an embodiment of the invention.

FIG. 3 shows an exemplary antenna arrangement according to an embodiment of the invention. In the embodiment, the antennas ANT1, ANT2, and ANT3 are disposed at the three vertices of an equilateral triangle, and the side length of the equilateral triangle is designed as $$\frac{\sqrt{3}}{3}\lambda.$$

Thus, the height of the triangle is $$\frac{\sqrt{3}}{3}\lambda\times\frac{\sqrt{3}}{2}=\frac{\lambda}{2}.$$

According to an embodiment of the invention, when the height of the triangle is designed as $$\left(i\times\lambda+\frac{\lambda}{2}\right),$$

where i may be 0 or any positive integer, the processor 120 may adjust the phases of the electronic wave signals at the feeding points of the antennas ANT1, ANT2, and ANT3 by respectively controlling the levels of the voltages V1, V2, and V3, such that differences between the phase of the signals at one antenna and the phases of the signals at the other antennas can be 180 degrees.

As discussed above, since the distances between the power amplifier 110 and each antenna may be designed to be identical, when the voltages V1, V2, and V3 provided to the PIN diodes D1, D2, and D3 are identical, the phases of the electronic wave signals at the feeding points of the three antennas will be identical. Suppose that a 5V voltage difference may cause 180 degrees of phase change, the processor 120 may control the voltages V1, V2, and V3 as 0V, 5V, and 5V, such that the phase of the electronic wave signals at the feeding point of antenna ANT1 is 0 degrees and the phases of the electronic wave signals at the feeding point of antennas ANT2 and ANT3 are 180 degrees. As shown in FIG. 3, the numbers in parentheses represent the phases of the electronic wave signals at the feeding point of the corresponding antennas. In this manner, the difference between the phase of the electronic wave signals at the feeding point of antenna ANT1 and the phase of the electronic wave signals at the feeding point of antenna ANT2, and the difference between the phase of the electronic wave signals at the feeding point of antenna ANT1 and the phase of the electronic wave signals at the feeding point of antenna ANT3, can be 180 degrees.

As shown in FIG. 3, since the height of the triangle is $$\frac{\lambda}{2},$$

when the electronic wave signals transmitted by the antennas ANT2 and ANT3 arrive at the tangent 301, a further 180-degree phase change will occur therein. Note that the tangent 301 is parallel to the line connecting the antennas ANT2 and ANT3. Therefore, when the electronic wave signals transmitted by the antennas ANT2 and ANT3 arrive at the tangent 301, the phases thereof will be identical with that of the electronic wave signals transmitted by the antenna ANT1. Finally, the electronic wave signals transmitted by the antennas ANT1, ANT2, and ANT3 will be radiated in the same upward direction as indicated by the arrows.

Note that the exemplary voltages and phases as illustrated above are just relative values, not absolute values. For example, by controlling the levels of the voltages V1, V2, and V3, those who are skilled in this technology can also design the phase of the electronic wave signals at the feeding point of the antenna ANT1 to be 90 degrees and the electronic wave signals at the feeding points of the antennas ANT2 and ANT3 to be 270 degrees, and the same result of the electronic wave signals transmitted by the antennas ANT1, ANT2, and ANT3 being radiated in the same upward direction as the arrows shown in FIG. 3 can be achieved. Therefore, the invention should not be limited to the values as mentioned above.

In addition, note that the control circuits as shown in FIG. 1 are not limited to being implemented by PIN diodes. For example, the control circuits may also comprise a plurality of transmission lines with different lengths and a switch device. By controlling the levels of the voltages V1, V2, and V3 and controlling the switching of the switch device, the transmission distances of the electronic wave signals can be adjusted such that the phases of the electronic wave signals can be adjusted accordingly. Therefore, the invention should not be limited to the structure shown in FIG. 1.

Figure 4:
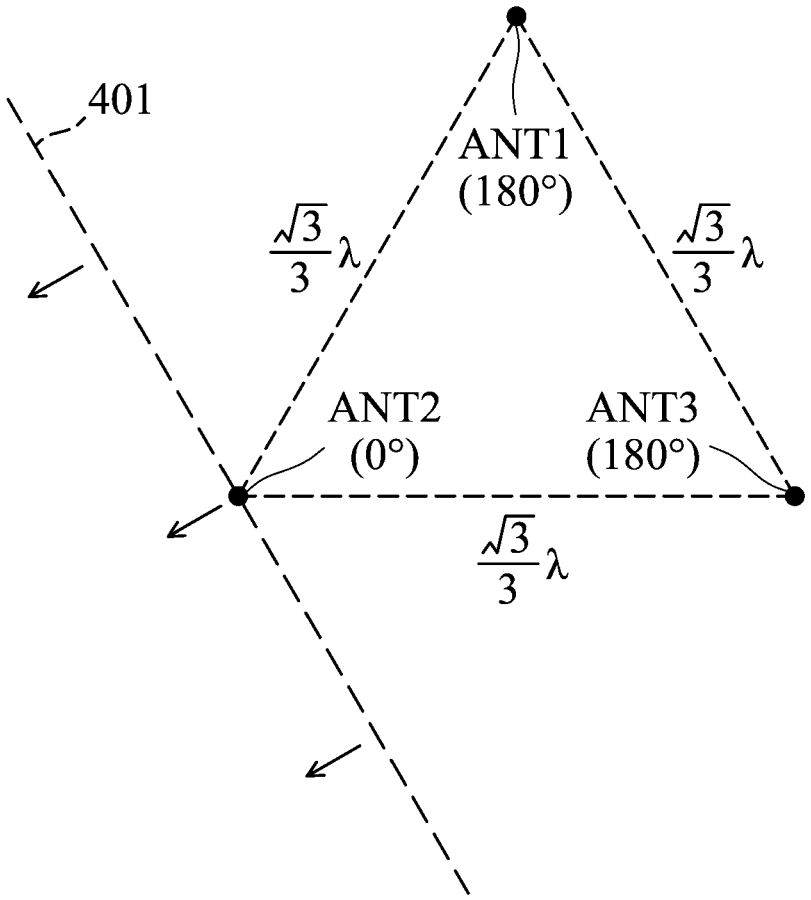
FIG. 4 shows another exemplary antenna arrangement according to another embodiment of the invention.

FIG. 4 shows another exemplary antenna arrangement according to another embodiment of the invention. In the embodiment, the antennas ANT1, ANT2, and ANT3 are disposed at the three vertices of an equilateral triangle, and the side length of the equilateral triangle is designed as $$\frac{\sqrt{3}}{3}\lambda.$$

Thus, the height of the triangle is $$\frac{\sqrt{3}}{3}\lambda \times \frac{\sqrt{3}}{2} = \frac{\lambda}{2}.$$

The processor 120 may adjust the phases of the electronic wave signals at the feeding points of the antennas ANT1, ANT2, and ANT3 by respectively controlling the levels of the voltages V1, V2, and V3, such that the phase of the electronic wave signals at the feeding point of the antenna ANT2 is 0 degrees, and the phases of the electronic wave signals at the feeding points of the antennas ANT1 and ANT3 are 180 degrees.

As shown in FIG. 4, since the height of the triangle is $$\frac{\lambda}{2},$$

when the electronic wave signals transmitted by the antennas ANT1 and ANT3 arrive at the tangent 401, a further 180-degree phase change will occur therein. Note that the tangent 401 is parallel to the line connecting the antennas ANT1 and ANT3. Therefore, when the electronic wave signals transmitted by the antennas ANT1 and ANT3 arrive at the tangent 401, the phases thereof will be identical with those of the electronic wave signals transmitted by the antenna ANT2. Finally, the electronic wave signals transmitted by the antennas ANT1, ANT2, and ANT3 will be radiated in the same direction as shown by the arrows.

Figure 5:
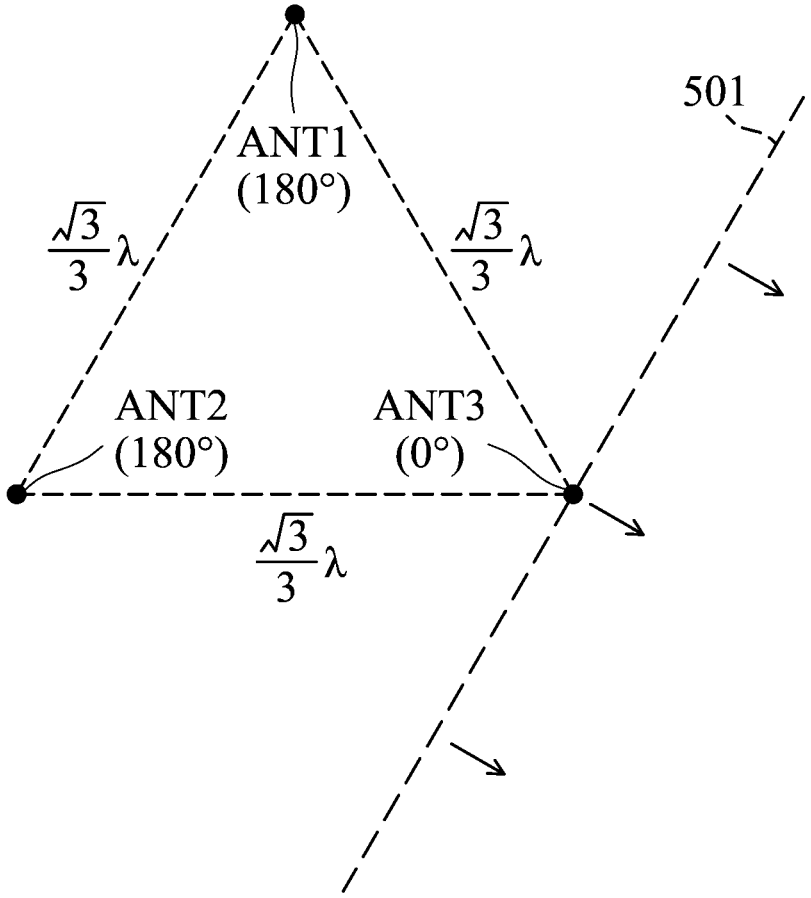
FIG. 5 shows another exemplary antenna arrangement according to yet another embodiment of the invention.

FIG. 5 shows another exemplary antenna arrangement according to yet another embodiment of the invention. In the embodiment, the antennas ANT1, ANT2, and ANT3 are disposed at the three vertices of an equilateral triangle, and the side length of the equilateral triangle is designed as $$\frac{\sqrt{3}}{3}\lambda.$$

Thus, the height of the triangle is $$\frac{\sqrt{3}}{3}\lambda \times \frac{\sqrt{3}}{2} = \frac{\lambda}{2}.$$

The processor 120 may adjust the phases of the electronic wave signals at the feeding points of the antennas ANT1, ANT2, and ANT3 by respectively controlling the levels of the voltages V1, V2, and V3, such that the phase of the electronic wave signals at the feeding point of the antenna ANT3 is 0 degrees, and the phases of the electronic wave signals at the feeding points of the antennas ANT1 and ANT2 are 180 degrees.

As shown in FIG. 5, since the height of the triangle is $$\frac{\lambda}{2},$$

when the electronic wave signals transmitted by the antennas ANT1 and ANT2 arrive at the tangent 501, a further 180-degree phase change will occur therein. Note that the tangent 501 is parallel to the line connecting the antennas ANT1 and ANT2. Therefore, when the electronic wave signals transmitted by the antennas ANT1 and ANT2 arrive at the tangent 501, the phases thereof will be identical to that of the electronic wave signals transmitted by the antenna ANT3. Finally, the electronic wave signals transmitted by the antennas ANT1, ANT2 and ANT3 will be radiated in the same direction as indicated by the arrows.

Figure 6:
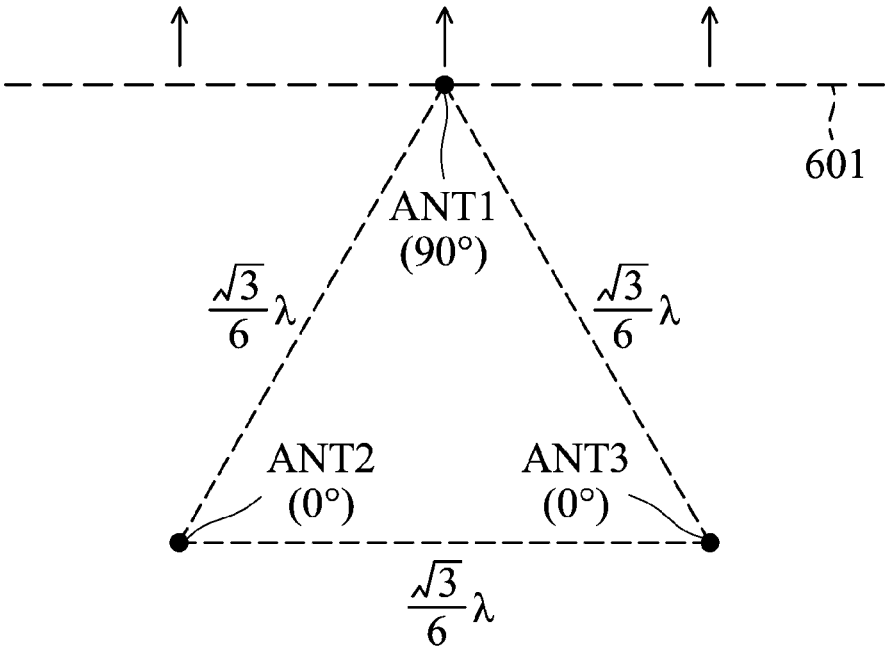
FIG. 6 shows another exemplary antenna arrangement according to still another embodiment of the invention.

FIG. 6 shows another exemplary antenna arrangement according to still another embodiment of the invention. In the embodiment, the antennas ANT1, ANT2, and ANT3 are disposed at the three vertices of an equilateral triangle, and the side length of the equilateral triangle is designed as $$\frac{\sqrt{3}}{6}\lambda.$$

Thus, the height of the triangle is $$\frac{\sqrt{3}}{6}\lambda \times \frac{\sqrt{3}}{2} = \frac{\lambda}{4}.$$

According to an embodiment of the invention, when the height of the triangle is designed as $$\left(i \times \lambda + \frac{\lambda}{4}\right),$$

where i may be 0 or any positive integer, the processor 120 may adjust the phases of the electronic wave signals at the feeding points of the antennas ANT1, ANT2, and ANT3 by respectively controlling the levels of the voltages V1, V2, and V3, such that the differences between the phase of the signals at one antenna and the phases of the signals at the other antennas can be 90 degrees. As shown in FIG. 6, the phase of the electronic wave signals at the feeding point of the antenna ANT1 is 90 degrees and the phases of the electronic wave signals at the feeding points of the antennas ANT2 and ANT3 are 0 degrees.

Since the height of the triangle is $$\frac{\lambda}{4},$$

when the electronic wave signals transmitted by the antennas ANT2 and ANT3 arrive at the tangent 601, a further 90-degree phase change will occur therein. Note that the tangent 601 is parallel to the line connecting the antennas ANT2 and ANT3. Therefore, when the electronic wave signals transmitted by the antennas ANT2 and ANT3 arrive at the tangent 601, the phases thereof will be identical with that of the electronic wave signals transmitted by the antenna ANT1. Finally, the electronic wave signals transmitted by the antennas ANT1, ANT2, and ANT3 will be radiated in the same upward direction as indicated by the arrows.

Figure 7:
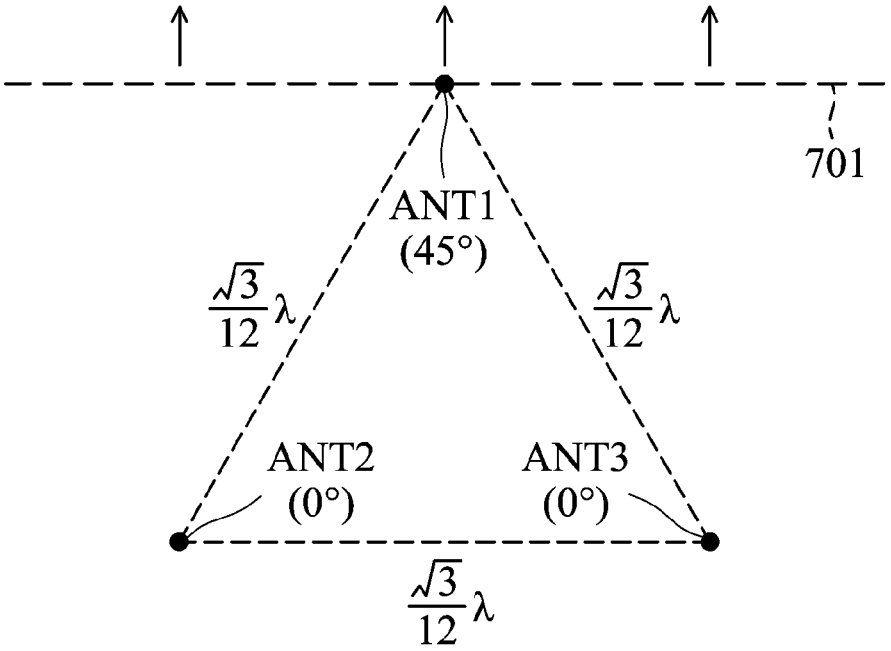
FIG. 7 shows another exemplary antenna arrangement according to still another embodiment of the invention.

FIG. 7 shows another exemplary antenna arrangement according to still another embodiment of the invention. In the embodiment, the antennas ANT1, ANT2, and ANT3 are disposed at the three vertices of an equilateral triangle, and the side length of the equilateral triangle is designed as $$\frac{\sqrt{3}}{12}\lambda.$$

Thus, the height of the triangle is $$\frac{\sqrt{3}}{12}\lambda \times \frac{\sqrt{3}}{2} = \frac{\lambda}{8}.$$

According to an embodiment of the invention, when the height of the triangle is designed as $$\left(i \times \lambda + \frac{\lambda}{8}\right),$$

where i may be 0 or any positive integer, the processor 120 may adjust the phases of the electronic wave signals at the feeding points of the antennas ANT1, ANT2, and ANT3 by respectively controlling the levels of the voltages V1, V2, and V3, such that the differences between the phase of the signals at one antenna and the phases of the signals at the other antennas can be 45 degrees. As shown in FIG. 7, the phase of the electronic wave signals at the feeding point of the antenna ANT1 is 45 degrees and the phases of the electronic wave signals at the feeding points of the antennas ANT2 and ANT3 are 0 degrees.

$$\frac{\lambda}{8},$$

Since the height of the triangle is when the electronic wave signals transmitted by the antennas ANT2 and ANT3 arrive at the tangent 701, a further 45-degree phase change will occur therein. Note that the tangent 701 is parallel to the line connecting the antennas ANT2 and ANT3. Therefore, when the electronic wave signals transmitted by the antennas ANT2 and ANT3 arrive at the tangent 701, the phases thereof will be identical with that of the electronic wave signals transmitted by the antenna ANT1. Finally, the electronic wave signals transmitted by the antennas ANT1, ANT2, and ANT3 will be radiated in the same upward direction as shown by the arrows.

Figure 8:
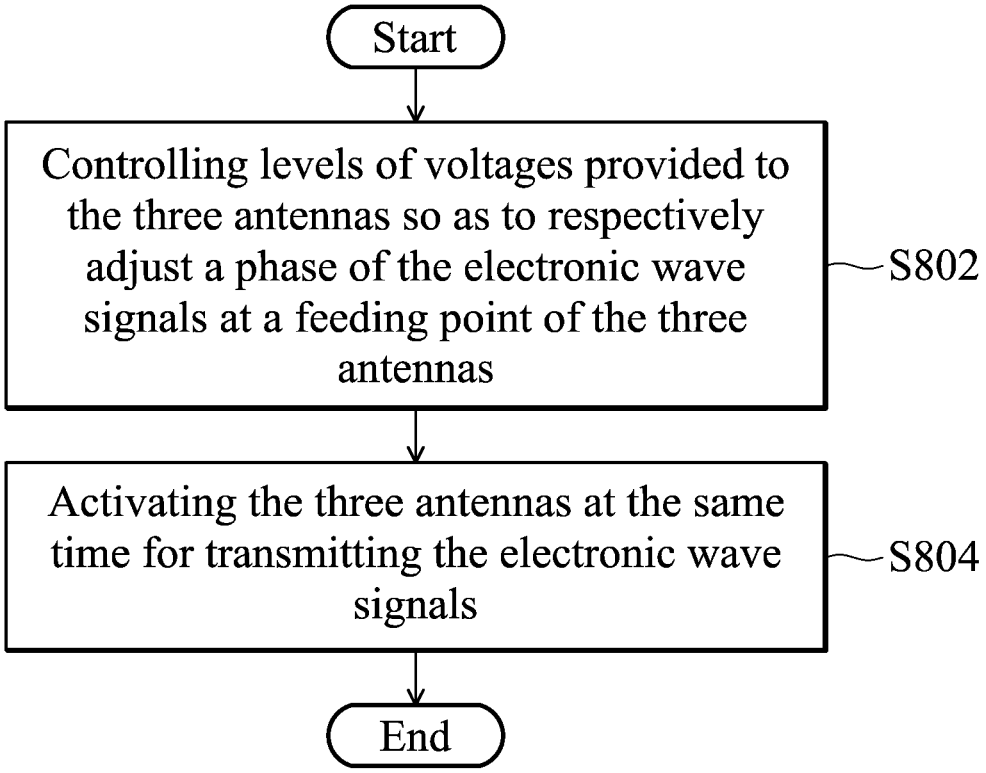
FIG. 8 is a flow chart of a method for operating a phased-array smart antenna according to an embodiment of the invention.

FIG. 8 shows a flow chart of a method for operating a phased-array smart antenna according to an embodiment of the invention. In the embodiment, the phased-array smart antenna may comprise three antennas for transmitting electronic wave signals, and the three antennas are preferably arranged as an equilateral triangle shape. First of all, the levels of voltages provided to the three antennas are respectively controlled so as to adjust a phase of the electronic wave signals at a feeding point of the three antennas (Step S802). Next, the three antennas are activated at the same time for transmitting the electronic wave signals (Step S804). As discussed, by adjusting the phases of the electronic wave signals at corresponding feeding points of the three antennas, the antenna field can be adjusted accordingly. In this manner, the radiation directions of the electronic wave signals can be flexibly controlled.

In addition, the proposed phased-array smart antenna may be applied in various wireless communications products, such as a Wireless Local Network (WLAN) access point (AP), a router, or others. When the wireless communications product equipped with the proposed phased-array smart antenna detects that a peer device has strong signal power in a predetermined direction, the phased-array smart antenna can be controlled in the ways illustrated above so as to control the electronic wave signals to be radiated in the predetermined direction. In addition, since the three antennas are activated at the same time, the antenna gain can be accumulated, increasing the signal-to-noise ratio and the capability to counter the multi-path fading effect in the wireless communications system. In addition, the signal transmitting distances can be increased and the signal quality improved.

The above-described embodiments of the present invention can be implemented in any of numerous ways. For example, the embodiments may be implemented using hardware, software or a combination thereof. It should be appreciated that any component or collection of components that perform the functions described above can be generically considered as one or more processors that control the above-discussed function. The one or more processors can be implemented in numerous ways, such as with dedicated hardware, or with general-purpose hardware that is programmed using microcode or software to perform the functions recited above.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of preferred embodiment, it is to be understood that the invention is not limited thereto. Those who are skilled in this technology can still make various alterations and modifications without departing from the scope and spirit of this invention. Therefore, the scope of the present invention shall be defined and protected by the following claims and their equivalents.

What is claimed is:

1. A phased-array smart antenna for transmitting an electronic wave signal having a wavelength, comprising:

a first antenna;

a second antenna;

a third antenna;

a first control circuit, coupled to the first antenna at a first node;

a second control circuit, coupled to the second antenna at a second node;

a third control circuit, coupled to the third antenna at a third node; and a processor, respectively controlling a first voltage provided to the first node, a second voltage provided to the second node, and a third voltage provided to the third node, wherein the first antenna, the second antenna, and the third antenna form a triangle and the first antenna, the second antenna, and the third antenna are respectively located at three vertices of the triangle, and the first antenna, the second antenna, and the third antenna are activated at the same time for transmitting the electronic wave signal; and wherein a height of the triangle is $$\left(i\times\lambda+\frac{\lambda}{2}\right),$$

where λ is the wavelength of the electronic wave signal and i is a non-negative integer, and wherein the processor adjusts a first phase of the electronic wave signal at a feeding point of the first antenna, a second phase of the electronic wave signal at a feeding point of the second antenna and a third phase of the electronic wave signal at a feeding point of the third antenna by controlling levels of the first voltage, the second voltage and the third voltage, respectively, such that a difference between the first phase and the second phase and a difference between the first phase and the third phase are 180 degrees.

2. The phased-array smart antenna as claimed in claim 1, wherein the first antenna, the second antenna, and the third antenna are omni-directional antennas.

3. The phased-array smart antenna as claimed in claim 1, wherein the triangle is an equilateral triangle.

4. The phased-array smart antenna as claimed in claim 3, wherein a side length of the triangle is $$\frac{\sqrt{3}}{12}n\lambda,$$

where n is a positive integer and λ is the wavelength of the electronic wave signal.

5. The phased-array smart antenna as claimed in claim 1, wherein the first control circuit, the second control circuit, and the third control circuit respectively comprises a P-intrinsic-N (PIN) diode, the PIN diode of the first control circuit is coupled between the first node and a ground, the PIN diode of the second control circuit is coupled between the second node and the ground, and the PIN diode of the third control circuit is coupled between the third node and the ground.

6. A method for operating a phased-array smart antenna, comprising a first antenna, a second antenna, and a third antenna, for transmitting an electronic wave signal having a wavelength, comprising:

respectively controlling levels of a first voltage provided to a first node of the first antenna, a second voltage provided to a second node of the second antenna and a third voltage provided to a third node of the third antenna, so as to adjust a first phase of the electronic wave signal at a feeding point of the first antenna, a second phase of the electronic wave signal at a feeding point of the second antenna and a third phase of the electronic wave signal at a feeding point of the third antenna, wherein the first antenna, the second antenna, and the third antenna form a triangle and are respectively located at three vertices of the triangle; and activating the first antenna, the second antenna, and the third antenna at the same time for transmitting the electronic wave signal, wherein the triangle is an equilateral triangle; and wherein a height of the triangle is $$\left(i\times\lambda+\frac{\lambda}{2}\right),$$

where λ is the wavelength of the electronic wave signal and i is a non-negative integer, and wherein the first phase, the second phase and the third phase are adjusted by controlling levels of the first voltage, the second voltage and the third voltage, such that a difference between the first phase and the second phase and a difference between the first phase and the third phase are 180 degrees.

7. The method as claimed in claim 6, wherein the first antenna, the second antenna, and the third antenna are omni-directional antennas.

8. The method as claimed in claim 6, wherein a side length of the triangle is $$\frac{\sqrt{3}}{12}n\lambda,$$

where n is a positive integer and λ is the wavelength of the electronic wave signal.

* * * * *